US005657997A

United States Patent [19]

Lührsen

[11] Patent Number: 5,657,997

[45] Date of Patent: Aug. 19, 1997

[54] FIXING DEVICE FOR A CERAMIC SEALING PLATE

[75] Inventor: Ernst Lührsen, Bad Schwalbach, Germany

[73] Assignee: Didier-Werke AG, Weisbaden, Germany

[21] Appl. No.: 433,053

[22] Filed: May 3, 1995

[30] Foreign Application Priority Data

May 3, 1994 [DE] Germany ..... 44 15 551.4

[51] Int. Cl.[6] ..... F16J 15/02; B22D 41/08; C21C 5/48

[52] U.S. Cl. ..... 277/11; 277/160; 222/600; 266/271

[58] Field of Search ..... 277/11, 160, 213; 266/271, 287; 222/590, 591, 600, 597; 251/326

[56] References Cited

U.S. PATENT DOCUMENTS

| | | | |
|---|---|---|---|
| 803,188 | 10/1905 | Oehlschlaeger | 277/160 |
| 2,044,272 | 6/1936 | Zahodiakin | 277/213 |
| 2,333,457 | 11/1943 | Zahodiakin | 277/213 |
| 2,383,825 | 8/1945 | Smith | 277/160 |
| 4,053,085 | 10/1977 | Brown et al. | 277/160 |
| 4,103,905 | 8/1978 | Desmond et al. | 277/160 |
| 4,266,787 | 5/1981 | Fukui | 277/160 |
| 4,384,554 | 5/1983 | Gotoda | 277/160 |
| 4,508,324 | 4/1985 | Lührsen et al. | 266/271 |
| 4,627,147 | 12/1986 | Kagi | 266/271 |
| 5,139,237 | 8/1992 | Fricker | 222/600 |

FOREIGN PATENT DOCUMENTS

| | | | |
|---|---|---|---|
| 0587485 | 3/1994 | European Pat. Off. | 222/600 |
| 3001 122 A1 | 7/1980 | Germany . | |
| 3223 181 C2 | 12/1983 | Germany . | |
| 3421 205 C2 | 10/1984 | Germany . | |
| 3712698 | 1/1988 | Germany | 222/600 |
| 4002611 | 8/1991 | Germany | 222/600 |

*Primary Examiner*—William A. Cuchlinski, Jr.
*Assistant Examiner*—John L. Beres
*Attorney, Agent, or Firm*—Wenderoth, Lind & Ponack

[57] ABSTRACT

A fixing device for a ceramic sealing plate in a carrying frame or cassette of a seal on a metallurgical vessel has the sealing plate held by a band on the carrying frame or the cassette. To press the sealing plate evenly along its perimeter, the band is corrugated in its longitudinal direction. One set of ridges of the band lies elastically on the sealing plate. The ridges lying between the one set lie elastically on the carrying frame or on the cassette, or on a spacer sheet between the band and the carrying frame of the cassette.

19 Claims, 2 Drawing Sheets

FIXING DEVICE FOR A CERAMIC SEALING PLATE

BACKGROUND OF THE INVENTION

1. Field of the Invention

The invention relates to a fixing device for a ceramic sealing plate in a carrying frame or a cassette of a seal, in particular a sliding seal on a metallurgical vessel, having a band arranged between the sealing plate and the carrying frame or the cassette surrounding and holding the sealing plate.

2. State of the Prior Art

An arrangement of this kind is described in DE 34 21 205 C2. In this arrangement a strap retainer is used that is tensible by means of a fastening attached on the carrying frame around the sealing plate. On the longitudinal sides of the sealing plate, the force with which the strap retainer is applied is slight at most. This arrangement is also costly. A similar arrangement is also described in DE 32 23 181 C2.

According to DE 30 01 122 A1, a sealing plate is held on a carrying frame with individual elastic profile pieces. These are provided in a gap running between the sealing plate and the carrying frame where the gap extends in a straight line. In the curved area of the gap or the sealing plate the sealing plate is not held fixed. For this reason the fixing of the sealing plate is uneven along the perimeter of the sealing plate.

In other arrangements in the prior art, the sealing plate is embedded in mortar in the carrying frame, or the carrying fame is shrunk onto the sealing plate. Both of these arrangements are associated with considerable expenditure and make the exchange of the sealing plate, for example for repairs, more difficult. In the arrangement using shrinking, similarly to when using a strap retainer, only an uneven distribution of the tensile force results.

SUMMARY OF THE INVENTION

The object of the present invention is to provide a fixing device in which a sealing plate is substantially evenly fixed over its entire perimeter.

The above problem is solved by the present invention in the use of a band that is corrugated in the longitudinal direction, whereby the corrugations have one set of ridges that lies elastically on the sealing plate, and another set of ridges lying between the one set that lies elastically on the carrying frame or on the cassette.

The band extends along the perimeter of the sealing plate. Its ridges elastically press alternately against the sealing plate and against the carrying fame or the cassette. In this way the sealing plate is evenly fixed along on its entire perimeter in the carrying frame or the cassette. Any tolerances of the sealing plate and the carrying frame or the cassette are balanced by the springy elasticity of the corrugated band.

In a preferred configuration of the invention, the ridges lying on the sealing plate are provided with flattened areas that lie flat on the sealing plate. In this way an even transmission of the tensile force to the ceramic sealing plate is achieved. In this way the compressive resistance of the ceramic of the sealing plate will not be exceeded, even at high levels of tensile force, which could be the case when the ridges contact the sealing plate only with a line or contact area.

It is also possible to provided the ridges lying on the carrying frame or the cassette with flattened areas which lie flat against the carrying frame or the cassette. Preferably the ridges facing the carrying frame of the cassette are rounded, however. It is possible in this way to arrange more ridges on the band than if the ridges facing the carrying frame or the cassette were provided with flattened areas. In this way the fixing of the sealing plate is improved.

The invention furthermore contemplates that the corrugated band inserted between the carrying frame or the cassette and the sealing plate is compressed toward its free condition. To compress the band, a spacer sheet is arranged preferably between the ridges facing the carrying frame or the cassette and the carrying frame or the cassette.

BRIEF DESCRIPTION OF THE DRAWINGS

Additional advantageous configurations of the invention result from the dependent claims and the following description. In the drawings.

DETAILED DESCRIPTION OF THE PREFERRED EMBODIMENT

Figure 1:
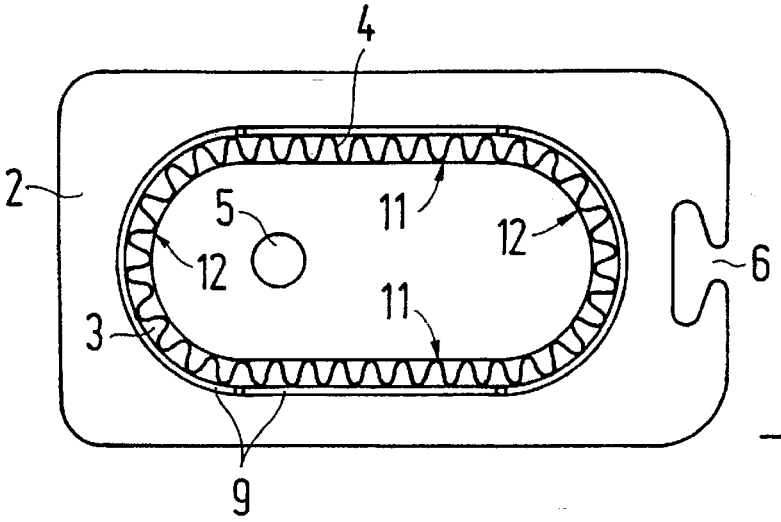
FIG. 1 is a top view of a sealing plate fixed in a carrying frame by a corrugated band according to the present invention.

A circumferential gap 3 exists between a ceramic sealing plate 1 and a metal carrying frame 2 receiving the ceramic sealing plate 1. To fix the sealing plate i in the carrying frame 2, a corrugated band 4 made of heat resistant spring steel is inserted in the gap 3. The sealing plate i is typically provided with a flow-through opening 5. The carrying frame 2 has a connector 6 by which it can be shifted together with the sealing plate 1 to close or open a sliding seal of a metallurgical vessel. The band 4 is corrugated in its longitudinal direction and forms ridges 7 which are pressed on the sealing plate 1 and ridges 8 between the ridges 7 which are supported on a spacer sheet 9 in the carrying frame 2.

Figure 2:
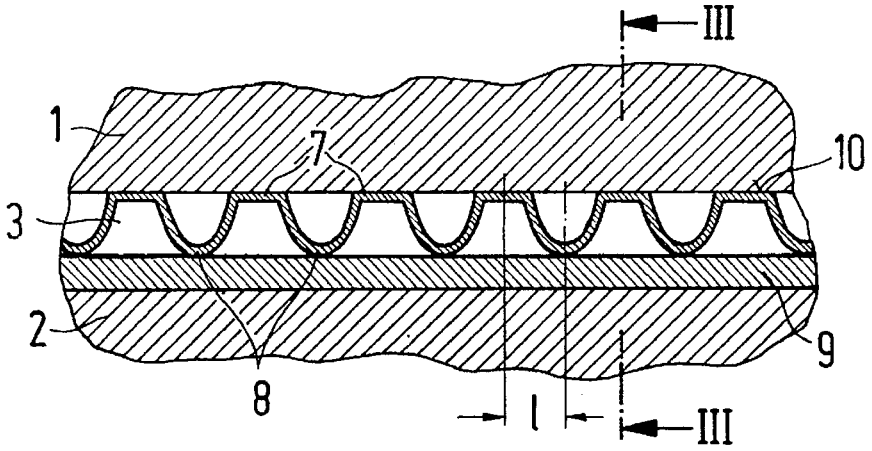
FIG. 2 is an enlarged partial view similar to FIG. 1 of a modification of the present invention.

In the embodiment in FIG. 2, the ridges 7 are provided with flattened areas 10 which lie flat on the sealing plate 1. The ridges 8 facing the carrying frame 2 are rounded.

Figure 4:
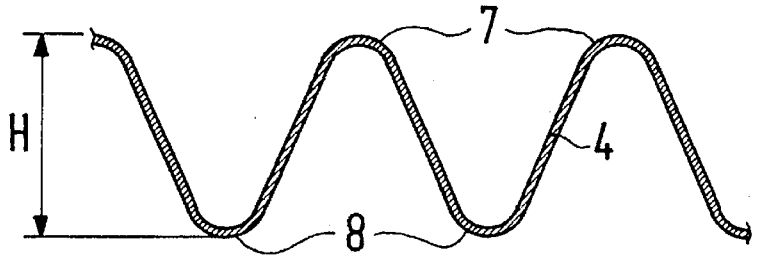
FIG. 4 is a partial view of a band in a non-tensile, free condition.
Figure 5:
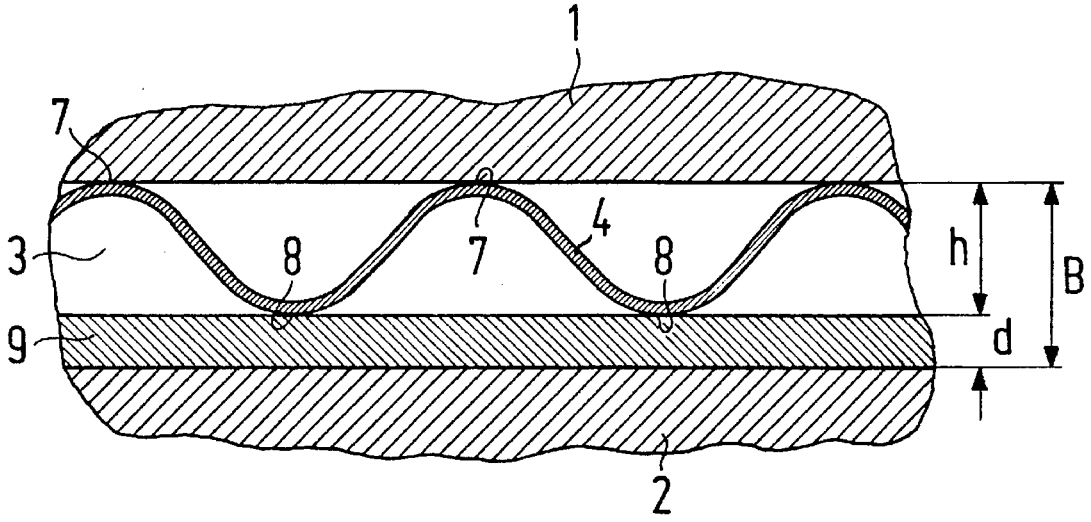
FIG. 5 is a view of the band in FIG. 4 in a tensile condition and FIG. 6 is a sectional view of a further embodiment of the band.

In the embodiment in FIGS. 4 and 5, the ridges 7 as well as the ridges 8 are rounded. This has an advantage in that the ridges can lie very close to one another. The disadvantage is, however, in particular for the ridges 7, that only a line of contact with the sealing plate 1 takes place, which assumes a correspondingly high compressive resistance of the ceramic to avoid damaging the ceramic of the sealing plate 1.

Figure 6:
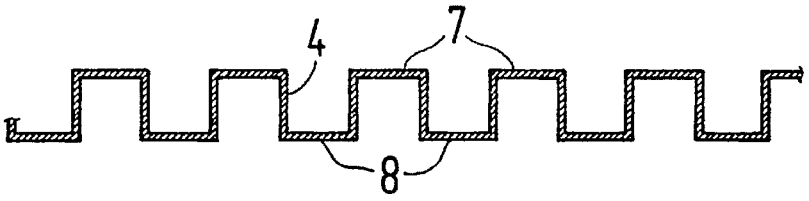

In the exemplary embodiment in FIG. 6, the ridges 7 as well as the ridges 8 are provided with flattened areas.

The embodiment in FIG. 2 has the advantage that the flattened areas 10 are only provided on the sealing plate 1. That is to say, no particularly high requirements are set for the compressive resistance of the ceramic of the sealing plate 1, and a thick succession of ridges 7 and 8 is still possible with the rounded ridges 8 on the carrying frame 2.

Ridges 7 and ridges 8 are provided in a linear perimeter area 11 as well as in a curved perimeter area 12. (See FIG. 1). In this way the sealing plate 1 is evenly fixed in the carrying frame 2 over its entire perimeter. The linear perimeter areas 11 form opposite sides of the ceramic sealing plate 1, and the curved perimeter areas 12 form opposite ends of the ceramic sealing plate 1. A plurality of corrugations are on each of these sides and on each of the ends, as can be seen from the figures. Spacer sheets 9 are provided in the linear perimeter area 11 as well as in the curved perimeter area 12. Instead of several spacer sheets 9 being used as in FIG. 1, a single spacer sheet can also be used.

Figure 3:
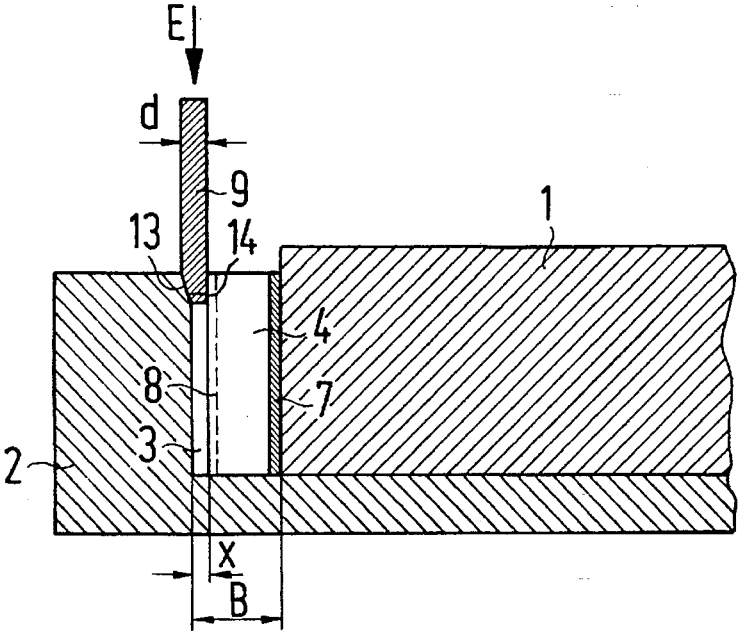
FIG. 3 is a sectional view taken along Line III—III of FIG. 2.

The corrugated band 4 is laid in the gap 3 in an unstressed condition in which the ridges 7 and 8 have a height distance H (see FIG. 4), whereby the distance H is approximately equal to the width B of the gap. The spacer sheets 9 are pressed in adjacent to the corrugated band 4 between the ridges 8 and the carrying frame 2 in the direction of an arrow E (see FIG. 3). To make this easier, the spacer sheets 9 are provided with bevels 13 and the carrying frame 2 is provided with a corresponding bevel 14. The spacer sheets have a thickness d. By pressing in the spacer sheets 9, the corrugated band 4 is compressed so that the height distance of the ridges 7 and 8 becomes h (see FIG. 5), whereby H=h+d. The distance H is, for instance, 5 mm, and is compressed to 3 mm with a spacer sheet 9 having a thickness of 2 mm. By this compression, the corrugated band 4 yields a desired tensile force on the sealing plate 1. For example, with a corrugated band, with a ridge of length 1 (see FIG. 2), whereby 1 is approximately 1 cm, a force of 100 kg/cm is transferred to the sealing plate 1. To facilitate the insertion of the corrugated band in the crevice 3, the distance H of the ridges 7, 8 can also be calculated in the unstressed condition to an amount x smaller than the width B of the gap. In this case, H=h+d−x. The intermediate distance x is, for instance, 3 mm, the distance H amounts to 5 mm and is compressed to 3 mm with a spacer sheet 9 having a thickness of 5 mm.

Normal tolerances of the sealing plate 1 and the carrying plate 2 are compensated by the springy elasticity of the band 4. Particularly large dimensional deviations between the sealing plate and the carrying plate are balanced by using spacer sheets 9 of various thicknesses.

Should a disassembly of the sealing plate 1 be necessary, the sealing plate 1 is hydraulically pressed out from the carrier frame 2 in a practical manner.

The same fixing device can be used without anything further for fixing the sealing plate 1 in a metal cassette. Such an arrangement is noticeably and significantly distinct from the carrying frame 2 only in that it does not have the gearing. A cassette with a fixed sealing plate 1 can be set into the carrying frame 2 in a known manner or coupled to the carrying frame 2.

I claim:

1. An apparatus, comprising:

a sealing plate holder having an opening therein;

a ceramic sealing plate disposed in said opening of said sealing plate holder, said ceramic sealing plate having opposite sides and opposite ends; and a corrugated band disposed between said sealing plate holder and said ceramic sealing plate in said opening including a plurality of corrugations along each of the opposite sides and a plurality of corrugations along each of the opposite ends of said ceramic sealing plate, both of said pluralities of corrugations of said corrugated band comprising first ridges facing said ceramic sealing plate and second ridges located between said first ridges and facing said sealing plate holder.

2. The apparatus of claim 1, wherein said second ridges comprise rounded areas contacting said sealing plate holder.

3. The apparatus of claim 1, and further comprising at least one spacer sheet between said second ridges and said sealing plate holder.

4. The apparatus of claim 3, wherein at least said at least one spacer sheet comprises a bevel thereon for facilitating the insertion of said at least one spacer sheet between said corrugated band and said sealing plate holder.

5. The apparatus of claim 4, wherein said sealing plate holder comprises a bevel thereon for facilitating the insertion of said at least one spacer sheet between said corrugated band and said sealing plate holder.

6. The apparatus of claim 3, wherein said corrugated band is in a compressed state between said at least one spacer sheet and said ceramic sealing plate.

7. The apparatus of claim 3, wherein said at least one spacer sheet comprises a plurality of spacer sheets.

8. The apparatus of claim 3, wherein said first and second ridges elastically engage said ceramic sealing plate and said at least one spacer sheet, respectively, to hold said ceramic sealing plate in said sealing plate holder.

9. The apparatus of claim 1, wherein said corrugated band is in a compressed state between said sealing plate holder and said ceramic sealing plate.

10. The apparatus of claim 1, wherein said corrugated band has a longitudinal direction extending around said ceramic sealing plate and approximately one ridge per centimeter in the longitudinal direction.

11. The apparatus of claim 1, wherein said corrugated band comprises heat resistant spring steel.

12. The apparatus of claim 1, wherein said corrugated band has a longitudinal direction extending around said ceramic sealing plate, said corrugated band being corrugated in the longitudinal direction such that said first and second ridges alternate in the longitudinal direction.

13. The apparatus of claim 1, wherein said sealing plate holder comprises a sealing plate carrying frame.

14. The apparatus of claim 1, wherein said sealing plate holder comprises a seal cassette.

15. The apparatus of claim 1, wherein said first and second ridges elastically engage said ceramic sealing plate and said sealing plate holder, respectively, to hold said ceramic sealing plate in said sealing plate holder.

16. An apparatus, comprising:

a sealing plate holder having an opening therein;

a ceramic sealing plate disposed in said opening of said sealing plate holder; and a corrugated band disposed between said sealing plate holder and said ceramic sealing plate in said opening, said corrugated band comprising first ridges facing said ceramic sealing plate and second ridges located between said first ridges and facing said sealing plate holder;

wherein said first ridges comprise flattened areas contacting said ceramic sealing plate.

17. The apparatus of claim 16, wherein said second ridges comprise flattened areas contacting said sealing plate holder.

18. The apparatus of claim 16, wherein said second ridges comprise rounded areas contacting said sealing plate holder.

19. An apparatus comprising:

a sealing plate holder having an opening therein;

a ceramic sealing plate disposed in said opening of said sealing plate holder; and a corrugated band disposed between said sealing plate holder and said ceramic sealing plate in said opening, said corrugated band comprising first ridges facing said ceramic sealing plate and second ridges located between said first ridges and facing said sealing plate holder wherein said second ridges comprise flattened areas contacting said sealing plate holder.

* * * * *